United States Patent [19]

Haza

[11] Patent Number: 4,561,654

[45] Date of Patent: Dec. 31, 1985

[54] DEVICE FOR ADJUSTING THE DIAMETER OF BOWLING BALL HOLES

[75] Inventor: Robert R. Haza, 2134 Gardner Rd., Westchester, Ill. 60153

[73] Assignees: Robert R. Haza, Westchester; Joseph Prestia, Worth, both of Ill. ; a part interest to each

[21] Appl. No.: 634,870

[22] Filed: Jul. 26, 1984

[51] Int. Cl.[4] ..... A63B 37/00

[52] U.S. Cl. ..... 273/63 B; 273/63 A

[58] Field of Search ..... 273/63 A, 63 B, 63 R

[56] References Cited

U.S. PATENT DOCUMENTS

| | | | |
|---|---|---|---|
| 2,210,528 | 8/1940 | Darby | 273/63 B |
| 2,372,958 | 4/1945 | Keith | 273/63 B |
| 2,372,959 | 4/1945 | Keith | 273/63 B |
| 3,001,793 | 9/1961 | Insetta | 273/63 B |

FOREIGN PATENT DOCUMENTS

| | | | |
|---|---|---|---|
| 646053 | 7/1962 | Canada | 273/63 B |

*Primary Examiner*—George J. Marlo

*Attorney, Agent, or Firm*—Laff, Whitesel, Conte & Saret

[57] ABSTRACT

An insert provides for varying the inside diameter of a hole in a device such as a bowling ball. The insert has a co-axial pair of telescoping tubes joined by a thread so that the tubes may be made longer or shorter by turning one of said tubes relative to another of the tubes. The inside tube terminates at its upper end in a conical wedge shape. A flexible tube or sleeve is cemented to the outside telescoping tube to be engaged by the inside tube as it telescopes. The flexible tube has a conical wedge on its outside surface for confronting the conical wedge shaped end of the inside tube. By turning one of the tubes, the two conical wedges advance toward or retract from each other to construct or relax the diameter of the flexible tube over a continuous range extending from a fully relaxed maximum diameter hole to a fully constricted minimum diameter hole.

17 Claims, 7 Drawing Figures

DEVICE FOR ADJUSTING THE DIAMETER OF BOWLING BALL HOLES

This invention relates to means for adjusting the diameter of a hole, and more particularly, to inserts for adjusting the size of a finger or thumb hole in a bowling ball or the like.

Bowling balls exemplify a situation where a precisely drilled hole is located in a relatively hard object. Most persons' fingers range in diameter from one-half to one inch. If the ball is custom-drilled for the user, the hole is generally satisfactory for that user for the present. If a different person is to use the ball, however, the fixed hole size may prevent use of that ball by that person. If the hole does not have a diameter which is large enough, it is possible, although not always convenient, to use sand paper, emery cloth or the like, to remove a little material and make the hole a little larger. On the other hand, if the diameter of the hole is too large, there is no easily apparent way of making the hole smaller. Therefore, the standard practice is to fasten some kind of a ring inside an oversized hole, the ring having a desired fixed inside diameter. This procedure generally requires the specialized equipment of a pro shop.

Another problem relates to the need for providing an adjustable or a variable hole diameter. For example, a simple change in temperature, humidity, or atmospheric pressure may result in body cells absorbing or giving up water so that fingers swell or reduce their diameter. Other things, such as a bruise, callus, or other trauma to the finger, may also cause the diameter of the fingers to change. The normal physical rubbing of the fingers against a ball during a bowling game may be enough to make them swell. If the bowling ball is uncomfortable, a bowler's score and the enjoyment of a game may well be affected. Thus, there is a need not only for a means for reducing the diameter of a hole but also for a means for varying the diameter of the hole, making it larger or smaller, at will.

Accordingly, one object of the invention is to provide new and novel means for and methods of reducing the diameter of a hole, especially a thumb or finger hole in a bowling ball. Another object of the invention is to provide an insert for adjustably changing the diameter of an existing finger or thumb hole of a bowling ball. Here, an object is to provide a bowling ball with adjustable diameter finger and thumb holes, which may be either increased or decreased.

In keeping with an aspect of the invention these and other objects are accomplished by providing an insert or liner for the hole of the bowling ball, including a telescoping pair of tubes or shells, which are interconnected by a screw thread. Therefore, the tubes may be made longer or shorter by rotating one of the tubes relative to the other. A flexible, cylindrical, tubular insert having a somewhat conically shaped exterior wall at one end is positioned to fit into and be engaged by the interior one of the telescoping tubes. As this tube, which is also rotatable, is turned on the threads in one direction, the telescoping pair is shortened and the interior tube is driven to engage and move up the conical portion of the flexible insert, to constrict the diameter of the flexible tube and to make it have a smaller inside diameter. If the inside tube is rotated in an opposite direction, the telescoping pair is lengthened and the interior tube is driven down or off the conical portion, thus enabling the flexible tube to expand and return to its original inside diameter.

Three embodiments of the invention are shown in the attached drawings, wherein.

Figure 1:
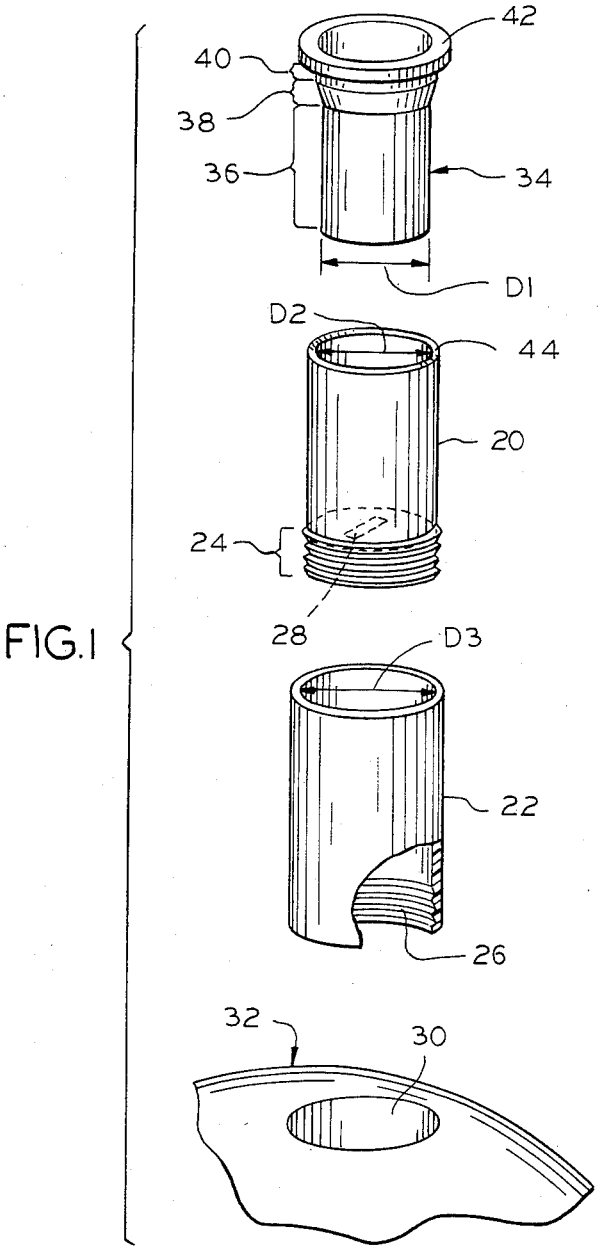
FIG. 1 is an exploded view of a preferred embodiment of the invention superimposed over a finger hole on a bowling ball.

The exploded view of FIG. 1 shows a pair of telescoping tubes 20, 22 which are joined by screw threads 24, 26. These tubes may be made of hard nylon, for example. A slot 28 is formed in the bottom of the inner tube 24 so that it may be turned by a screw driver. The outside wall of the outer tube 22 is cemented inside a finger hole 30 in a bowling ball 32. Therefore, when a screw driver in slot 28 turns the tube 20 in one direction, it moves upwardly within the fixed tube 22, and the telescoping pair shortens. When the slot 28 is turned in an opposite direction, the tube 20 moves downwardly within the fixed tube 22, and the telescoping pair lengthens.

Flexible tube 34 is generally flexible enough to constrict or expand responsive to an application of a circumferential pressure thereto. An exemplary material used for manufacturing the flexible tube is polyurethane, with an 80 durometer preferred. This material provides a 35% deflection for optimum life. Its hardness of 80 Shore A has a low load-bearing capacity, and is best used in lighter gages and softer materials. The manufacturer describes the physical properties of this material, as follows:

| | |
|---|---|
| 100% Modulus, psi | 400 |
| 300% Modulus, psi | 645 |
| Tensile Strength, psi | 3000 |
| Elongation at break, % | 800 |
| Hardness, Durometer Shore A | 80 |
| Hardness, Durometer Shore C | 33 |
| Specific Gravity at 75° F. | 1075 |
| Tear Strength, D-470, lb/in | 70 |
| Tear Strength, Graves, lb/in | 375 |
| Compression Set, Method B %, 22 hours at 158° F. | 45 |
| Linear Shrinkage, % | 1.5 |
| Brittleness Temperature, | −90° F. min. |
| Recommended % Penetration for optimum life | 35 |
| Abrasion Resistance, NBS Index | 110 |
| Coefficient of Friction, on 125 rms steel at 20 lbs load at 52 fpm | .80 |

In greater detail, the flexible tube 34 has a hollow, generally cylindrical part 36 which has an outside diameter D1 that fits snuggly within the inside diameter D2 of the inner tube 20. Above the cylindrical part 36, is a somewhat conical wedging part 38 which flares outwardly to an annular ring part 40 which fits snuggly within the inside diameter D3 of the outer and fixed telescoping tube 22. Above the ring 40, the flexible tube 34 terminates in an outwardly directed flange 42 having an outside diameter which is the same as the outside diameter of fixed tube 22 and the inside diameter of the hole 30. The conical wedge part 38 occupies a space which is first engaged and then engulfed by upper, wedge shaped, edge 44 of the inside tube 20, as it moves upwardly within the tube 22 responsive to the rotation of the slot 28. Also, the further the tube 20 moves upwardly, the higher it climbs on the conical wedge surface 38 of the flexible tube 34, and the more the internal diameter of flexible tube 34 is constricted.

Figure 2:
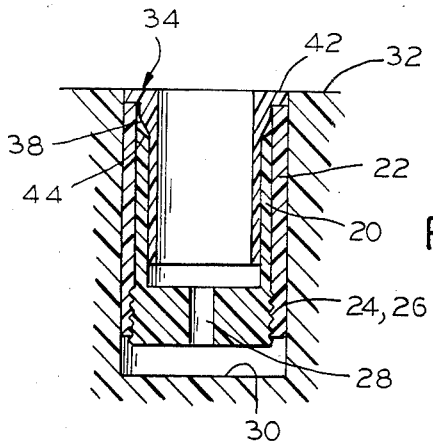
FIG. 2 shows the embodiment of FIG. 1 in place within a hole and in a relaxed condition to give the hole a large diameter.
Figure 3:
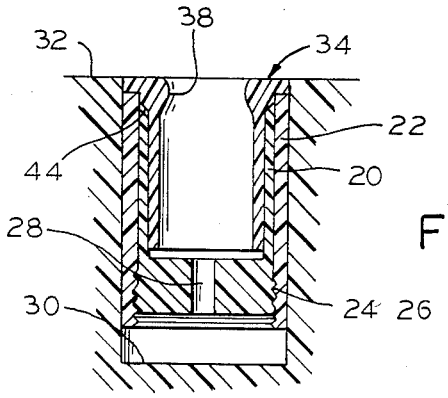
FIG. 3 is a similar cross sectional view showing the embodiment of FIG. 1 with the diameter of the hole constricted.

The operation is seen in FIGS. 2 and 3. The outside and fixed tube 22 is cemented around its outside cylindrical periphery to the inside of the hole 30, in bowling ball 32. The outer and fixed tube is sunk into the hole 30 far enough so that flange 42 fits smoothly within hole 30 and flush with the surface of the ball 32. In FIG. 2, the screw driver slot 28 has been turned to drive the tube 20 downwardly and into the hole 30 far enough so that the upper wedging edge 44 does not engage the conical part 38 of flexible tube 34. Accordingly, the flexible tube 34 is relaxed and the diameter of its internal hole is the maximum that it may become.

To adjust and reduce the effective diameter of the hole, a screw driver is placed into the hole with its blade in the slot 28. The screw driver is turned and inside tube 20 is driven upwardly, as it turns on screw threads 24, 26. As the tube 20 moves upwardly, the wedging end 44 moves over the conical wedge section 38, forcing it radially inward, thus causing a constriction within the hole 30, as shown in FIG. 3. The amount of constriction depends upon how much of the conical section 38 is engulfed within the inside diameter D2 of tube 20. Therefore, by rotating the inside tube, the diameter of the hole may be any distance between a maximum, when the flexible tube is in a fully relaxed condition (FIG. 2) and where wedging end 44 of tube 20 does not engage the conical part, and the minimum or fully constricted condition, where wedging end 44 has fully engulfed the conical wedge member 38. With this embodiment, a range of approximately one-tenth of an inch in diameter can be achieved, which is more than adequate variation to compensate for most fluctuations in finger diameter.

Figure 4:
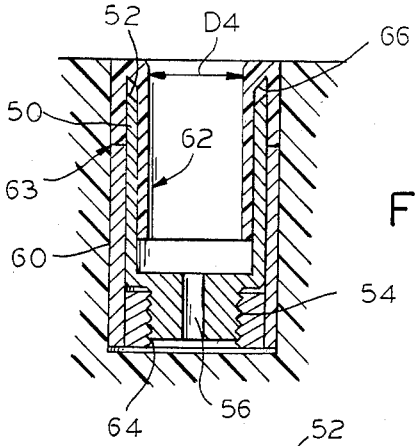
FIGS. 4 and 5 are cross sectional views which show an alternative embodiment in relaxed and constricted conditions, respectively.
Figure 5:
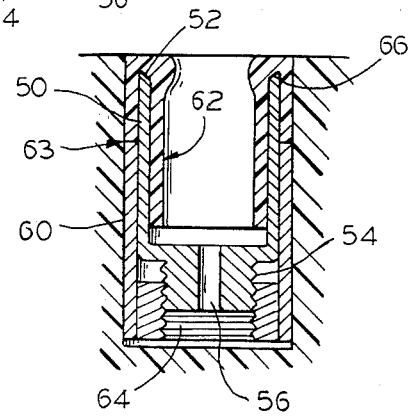

A second embodiment is seen in FIGS. 4 and 5. The moving, inner shell 50 has a wedging upper edge 52 and a threaded lower end 54, containing a screw driver slot 56. Part 60 is a thimble shaped member, preferably made of hard nylon, and having screw threads formed in the bottom, for receiving threads 54 on the lower end of inner part 50. Flexible part 62 is a flexible member similar to flexible sleeve 34, preferably made of polyurethane. Part 62 is folded back upon itself to provide the top outside portion and all of the inside portion of the double walled cylinder 60, 62. After the inner shell 50 is in place inside part 60, the two parts 60, 62 are joined or bonded together at 63 to coaxially form a double walled cylinder which becomes the outer and fixed tube. Only the relatively hard sleeve 60 is bonded to the interior of the finger hole. Otherwise, the installation of the embodiment of FIGS. 4 and 5 in the hole 30 is the same as that described above in connection which FIGS. 2 and 3.

Inside the fold and at the top of the double cylinder wall, the upper interior surface of the flexible member 62 has a conical wedge shape 66, which complements the wedging conical edge 52 at the top edge of the inner shell 50. When the wedge shapes 52, 66 are separated, as seen in FIG. 4, the diameter D4 of the finger hole is maximum. As the inner shell 50 raises on the screw threads 54, 64, the two wedging edges 52, 66 come together to cause the interior diameter D4 to constrict. By varying the height of the inner shell 50, the diameter D4 may be varied between the maximum and minimum limits of FIGS. 4 and 5, respectively.

Figure 6:
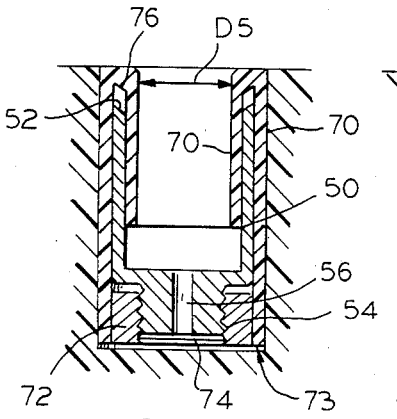
FIGS. 6 and 7 are similar cross section views of second alternative embodiments in relaxed and constricted conditions.
Figure 7:
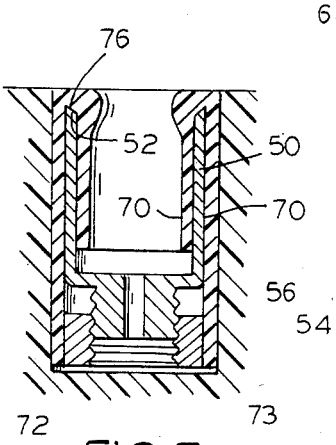

FIGS. 6 and 7 show another embodiment which is similar to that shown in FIGS. 4 and 5. The same inner shell 50 and slot 56 are used in both of the embodiments of FIGS. 4–7.

The flexible sleeve 70 (FIGS. 6, 7) is folded back upon itself to form the entire double walled cylinder, thus eliminating hard shell 60 and the need for joining at 63, as shown in FIG. 4. After the inner shell 50 is in place between the double walls of flexible sleeve 70, a short cylindrical plug of a relatively hard material 72 is bonded at the bottom 73 inside the outer cylindrical wall. Screw threads 74 are formed in the plug 72 to receive the screw threads 54 on the bottom of inner shell 50. The inside edge of the folded back cuff terminates in an internal conical wedge surface 76. When the conical wedge surfaces 52, 76 are separated as in FIG. 6, the hole diameter D5 is at its maximum. As the inner sleeve 50 is turned on threads 54, 74, it raises and the two wedge shapes 52, 76 come together to constrict the diameter of the hole (FIG. 7). Again the amount of constriction depends upon how high the sleeve 50 is raised.

The installation of the embodiment of FIGS. 6, 7 in the bowling ball hole is substantially the same as described above for FIGS. 4, 5. The bonding or cementing between the insert and the finger hole is restricted to a level which does not interfere with the constriction of diameter D5.

The finger engaging texture is controlled in the interiors of the flexible tubes 34, 62, 70 in each of the three embodiments of FIGS. 1, 4, 5, respectively. This texture is established by texturing the corresponding wall of the mold used to make the flexible sleeve. That mold wall texture is established by an acid etch, sand blasting, or a grinding with coarse grit to establish a hill and dale surface measured in micro-inches (one-millionth an inch) between peaks and valleys. The hill to dale distance may preferably be 1 to 250 micro-inches. However, depending upon the preference of the user, it may vary up to 30,000 micro-inches.

Those who are skilled in the art will readily perceive how to modify the system. Therefore, the appended claims are to be construed to cover all equivalent structures which fall within the true scope and spirit of the invention.

The invention claimed is:

1. An insert for providing a variable inside diameter of a hole, said insert comprising a co-axial pair of telescoping tubes joined by a thread whereby the tube may be made longer or shorter by turning one of said tubes relative to another of said tubes, at least one of said tubes terminating at its upper end in a conical wedging shape; a flexible sleeve member associated with said telescoping tubes, said flexible member having an internal bore defining the hole and having a conical wedge surface on at least a portion of the outside of said sleeve near the entrance of the hole, said outside sleeve engagingly confronting the conical wedge shape terminating said one tube; and means for turning said one tube from outside the hole to cause said upper conical wedge to advance toward or to retract from the conical wedge on the outside surface of said flexible sleeve member, thereby constricting or relaxing the diameter of the entrance of the hole defined by said bore, the diameter at the entrance of said flexible sleeve over a continuous range extending from a fully relaxed to a fully constricted diameter.

2. The insert of claim 1 wherein said hole is a finger hole of a bowling ball and wherein the outer one of said co-axial tubes is bonded to the inside of said finger hole, said upper conical wedging end being on the inner one of said tubes.

3. The insert of claim 2 wherein the turning one of said co-axial tubes terminates in a screw-driver slot for enabling said turning of said tube on said threads.

4. The insert of claim 2 wherein said turning means can be adjusted after the insert is in place within the bowling ball.

5. The insert of claim 2 wherein said flexible sleeve comprises a flange on one end, said flange having an outside diameter corresponding to the inside diameter of said finger hole; said conical wedge on said flexible sleeve is below said flange, and a cylindrical member below said conical wedge for receiving said finger.

6. The insert of claim 2 wherein said flexible sleeve member has an annular ring section positioned between said conical wedge surface and said flange, the outside diameter of said ring section being substantially the same as the inside diameter of the outside one of said co-axial tubes.

7. The insert of claim 1 wherein said flexible sleeve comprises a sleeve which is folded back upon itself with a generally wedge shape surface along at least a portion of the inside of said fold back for relaxing and constricting responsive to said wedging shaped upper end of said one tube.

8. The insert of claim 7 wherein said folded back sleeve is joined to the outer one of said telescoping tubes.

9. The insert of claim 8 wherein said joining is at a point near the upper end of said insert.

10. The insert of claim 8 wherein said joining is near the bottom end of said insert.

11. The insert of claim 1 wherein said flexible sleeve is polyurethane.

12. The insert of claim 1 wherein said flexible sleeve has the following physical properties:

| | |
|---|---|
| 100% Modulus, psi | 400 |
| 300% Modulus, psi | 645 |
| Tensile Strength, psi | 3000 |
| Elongation at break, % | 800 |
| Hardness, Durometer Shore A | 80 |
| Hardness, Durometer Shore C | 33 |
| Specific Gravity at 75° F. | 1075 |
| Tear Strength, D-470, lb/in | 70 |
| Tear Strength, Graves, lb/in | 375 |
| Compression Set, Method B %, 22 hours at 158° F. | 45 |
| Linear Shrinkage, % | 1.5 |
| Brittleness Temperature, | −90° F. min. |
| Recommended % Penetration for optimum life | 35 |
| Abrasion Resistance, NBS Index | 110 |
| Coefficient of Friction, on 125 rms steel at 20 lbs load at 52 fpm | .80 |

13. The insert of claim 1 wherein said flexible sleeve defines a liner for a finger hole of a bowling ball, said liner having an interior hill and dale texture for frictional engagement by the finger, said hill and dale having a peak to valley distance in the order of 1 to 250 micro-inches.

14. The insert of claim 1 wherein said flexible sleeve defines a liner for a finger hole of a bowling ball, said liner having an interior hill and dale texture for frictional engagement by the finger, said hill and dale having a peak to valley distance which does not exceed 30,000 micro-inches.

15. The insert of claim 1 wherein the inside diameter of the hole can be varied within a continuous range of about one-tenth of an inch.

16. A method for providing a variable diameter liner for a bowling ball finger hole, comprising the steps of:

(a) forming a telescoping pair of tubes wherein one tube terminates in a wedging edge, (b) attaching a flexible cylindrical sleeve inside said telescoping pair in a manner which forms a liner for said finger hole, said sleeve having a portion of its outside surface in a conical shape, and (c) adjusting the length of said telescoping pair of tubes from a point outside said finger hole, said adjustable length bringing said wedging edge into contact with the outside conical surface of said flexible sleeve to constrict or relax it, whereby the diameter of the liner is adjusted.

17. The method of claim 16 and the added step of texturing the interior part of the liner which is engaged by a finger of a user.

* * * * *